US006752060B1

(12) United States Patent
Griffin

(10) Patent No.: US 6,752,060 B1
(45) Date of Patent: Jun. 22, 2004

(54) MISSILE LAUNCHER

(75) Inventor: Dennis Griffin, Guildford (GB)

(73) Assignee: MBM Technology Limited, Brighton (GB)

( * ) Notice: Subject to any disclaimer, the term of this patent is extended or adjusted under 35 U.S.C. 154(b) by 1572 days.

(21) Appl. No.: 08/999,533

(22) Filed: Jan. 23, 1998

(30) Foreign Application Priority Data

Jan. 23, 1997 (GB) ..... 9701355

(51) Int. Cl.[7] ..... F41F 3/06; F41F 3/077
(52) U.S. Cl. ..... 89/1.817; 89/1.806
(58) Field of Search ..... 89/1.817, 1.816, 89/1.818, 1.819, 1.8, 1.809, 1.81, 1.806, 1.807, 1.808

(56) References Cited

U.S. PATENT DOCUMENTS

| | | | | | |
|---|---|---|---|---|---|
| 2,790,352 | A | * | 4/1957 | Jewett et al. | 89/1.817 |
| 3,158,062 | A | * | 11/1964 | Feiler | 89/1.818 |
| 3,311,325 | A | * | 3/1967 | Miller | 89/1.8 |
| 3,808,942 | A | * | 5/1974 | Bhutani et al. | 89/1.816 |
| 3,892,194 | A | * | 7/1975 | Goedde et al. | 89/1.809 |
| 4,033,225 | A | * | 7/1977 | Kartzmark, Jr. | 89/1.81 |
| 4,098,168 | A | * | 7/1978 | Seeger et al. | 89/1.819 |
| 4,301,708 | A | * | 11/1981 | Mussey | 89/1.81 |
| 4,492,143 | A | * | 1/1985 | Ruhle | 89/1.81 |
| 4,498,368 | A | * | 2/1985 | Doane | 89/1.817 |
| 5,062,345 | A | * | 11/1991 | Tegel et al. | 89/1.81 |

FOREIGN PATENT DOCUMENTS

| | | |
|---|---|---|
| GB | 1 428 063 | 3/1976 |
| GB | 1 501 079 | 2/1978 |

* cited by examiner

*Primary Examiner*—Stephen M. Johnson
(74) *Attorney, Agent, or Firm*—Burns, Doane, Swecker & Mathis, L.L.P.

(57) ABSTRACT

A method of launching a missile in a given direction is described comprising the steps of:

i) storing a missile in a housing ii) ejecting the missile from the housing while imparting a tumbling motion to the missile, the direction of tumble being selected to decrease the angle between the longitudinal axis of the missile and the given direction and iii) firing the missile and steering it to the given direction.

By such a method a missile launcher is provided which is capable of firing a missile at any azimuth angle of between 0 and 360°, within 0.1 second of receiving a signal to launch. The missile may be launched by a single ejector piston at the base of the missile acting in a direction off-set from the longitudinal axis of the missile.

14 Claims, 5 Drawing Sheets

MISSILE LAUNCHER

BACKGROUND OF THE INVENTION

Field of the Invention

This invention relates to a missile launcher and in particular to missile launcher capable of launching a missile to engage an off-bore sight target with minimal delay.

DESCRIPTION OF THE RELATED ART INCLUDING INFORMATION DISCLOSED UNDER 37 C.F.R. §1.97 AND §1.98

Current designs of missiles are not capable of rapid and directional launch; they tend either to be directed toward a target which is near the axis of the missile on launch or, if the target is not near the missile axis on launch, time is taken to redirect the missile after launch.

However, when the direction or attack is unpredictable and only a very short time window is available for effective response, the pointing of an entire launcher with its missile (s) in the direction of the target is normally an impractical proposition. For example, a response time in the order of 100 milliseconds is required for a self-defense missile to intercept, for example, incoming missiles, attacking aircraft or re-entering ballistic warheads. The rocket motor on such a missile needs to develop a huge thrust level and rate of change of thrust to produce the necessary acceleration and rapid response. In addition, efflux gases are difficult to dispose of in many circumstances.

A missile launching system capable of rapid directional launch is therefore required.

BRIEF SUMMARY OF THE INVENTION

The invention provides a method of launching a missile in a given direction comprising the steps of:

i) storing a missile in a housing ii) ejecting the missile from the housing while imparting a tumbling motion to the missile, the direction of tumble being selected to decrease the angle between the longitudinal axis of the missile and the given direction and iii) firing the missile and steering it to the given direction.

The invention further provides a missile launcher for use in the above method and comprising:

i) a generally tubular housing in which a missile may be housed, the internal diameter of the housing being larger than the diameter of the missile; and, ii) an ejector operable in use to eject the missile from the housing by a force acting along an ejection axis off-set from the longitudinal axis of the missile and imparting a tumbling motion to the missile.

In a preferred embodiment of the invention (see drawings) the ejector is a piston which acts on the base of the missile.

BRIEF DESCRIPTION OF THE SEVERAL VIEWS OF THE DRAWINGS

Further features of the invention are apparent from the claims and the following description with reference to the attached drawings, in which:

DESCRIPTION OF THE INVENTION

In general, the lower the mass of the missile the more agile it can be, and the more readily it may be rapidly translated out of its storage housing and rotated to point in the appropriate direction. The example given here is for a lightweight missile, which is required to be pointing in the correct direction and be clear of the launcher within 0.1 seconds of launch command.

In the following, in referring to directions, the terms azimuth and elevation are used as though the launch housing of the missile were vertically disposed. It will of course be apparent that the launch housing of the missile may be disposed at a variety of angles and the terms azimuth and elevation should therefore be interpreted as relative terms.

Figure 1:
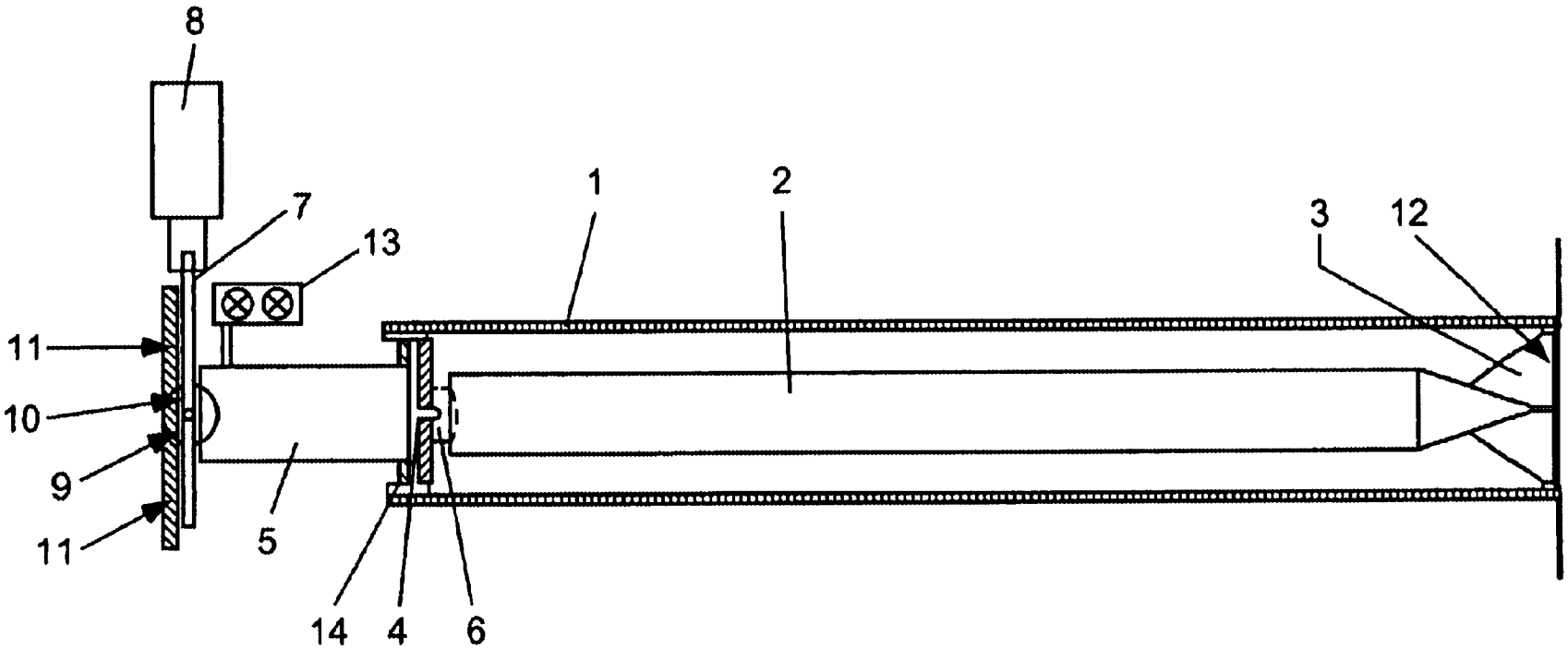
FIG. 1 shows a cross-section of a missile launcher according to the invention.

FIG. 1 shows a launch housing 1, of generally tubular form, which provides a storage container for the missile prior to deployment, and which is fixed to the launch platform. The housing does not need to be of circular cross-section nor do the wails need to be complete. A perforated frame housing may be used if appropriate to the launch platform environment. In this example the housing is within the airframe of an aircraft or within a suitably streamlined appendage thereto. The axis of the housing may be normal to the outer surface of its housing or the housing may be mounted at an oblique angle to afford a degree of directional pre-alignment. If the housing is situated normal to the surface then the launcher would have an equal ability to point the missile in any angle of azimuth but if the threat direction can be constrained then an even more rapid average target engagement is possible.

The launch housing 1 is larger than the minimum diameter needed to accommodate its missile 2 so that directional rotation or tumbling motion of the missile may begin while the missile is still partially within the launch housing. The degree of annular clearance between missile and housing bore is determined by the required dynamics of launch and is calculated so as to enable the maximum necessary angle to be obtained at end of launch.

Figure 2:
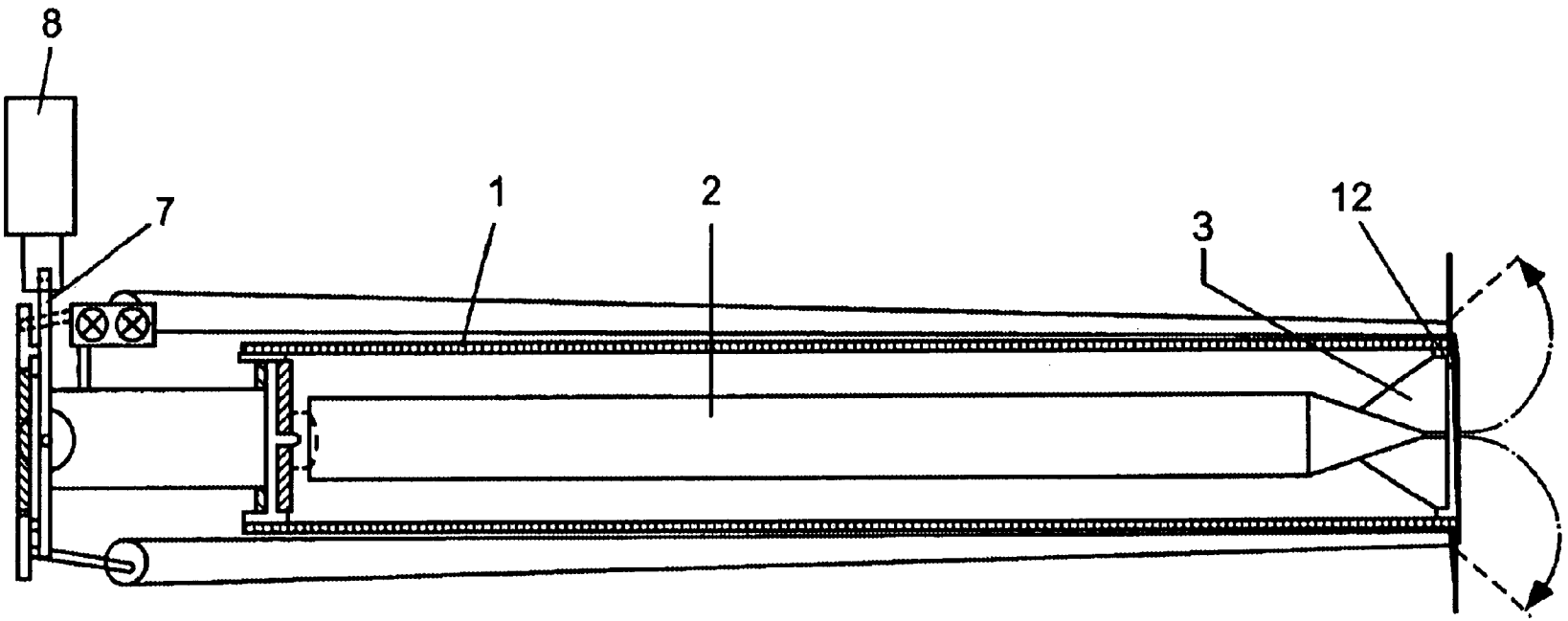
FIG. 2 shows a cross-section of a missile launcher according to the invention, showing a mechanism for opening doors in the end of the housing through which the missile exits.
Figure 3A:
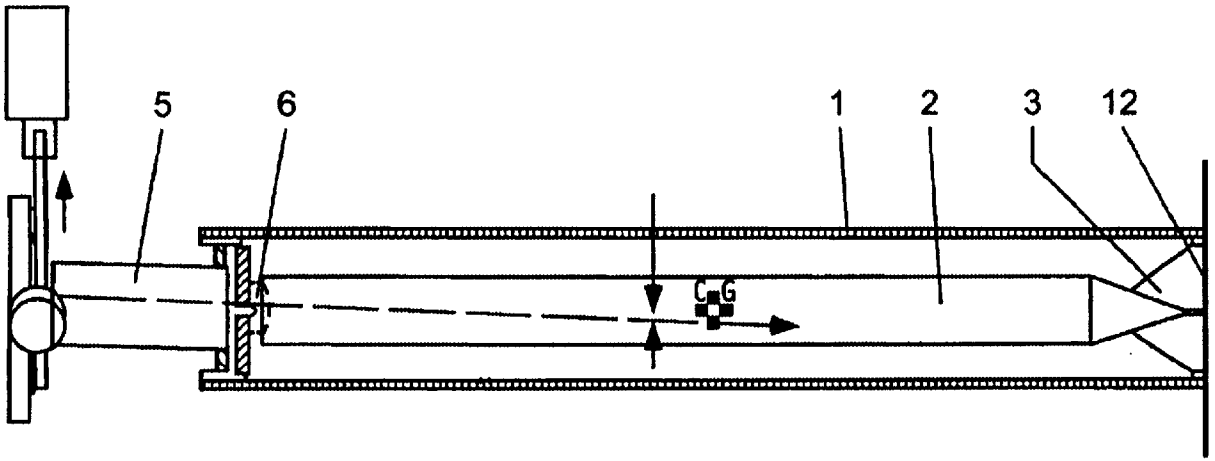
FIGS. 3*a* to 3*d* show a cross-section of a missile launcher according to the invention detailing the position of the missile and piston during the launch sequence.
Figure 3B:
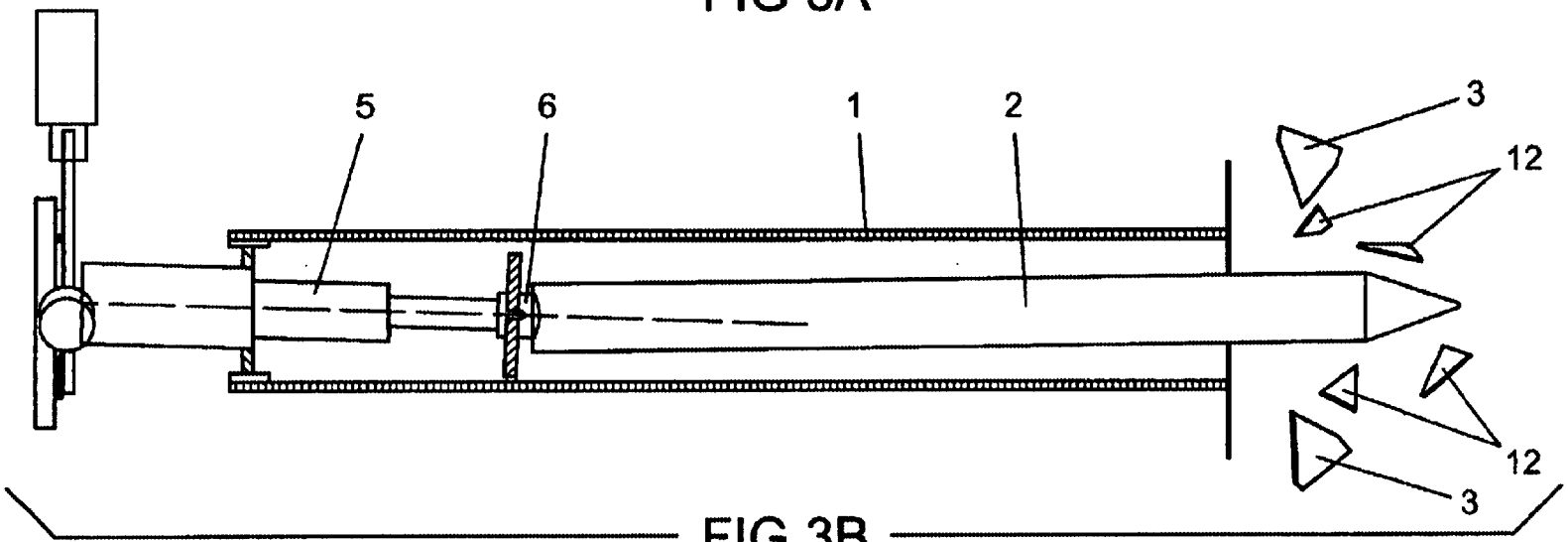
Figure 3C:
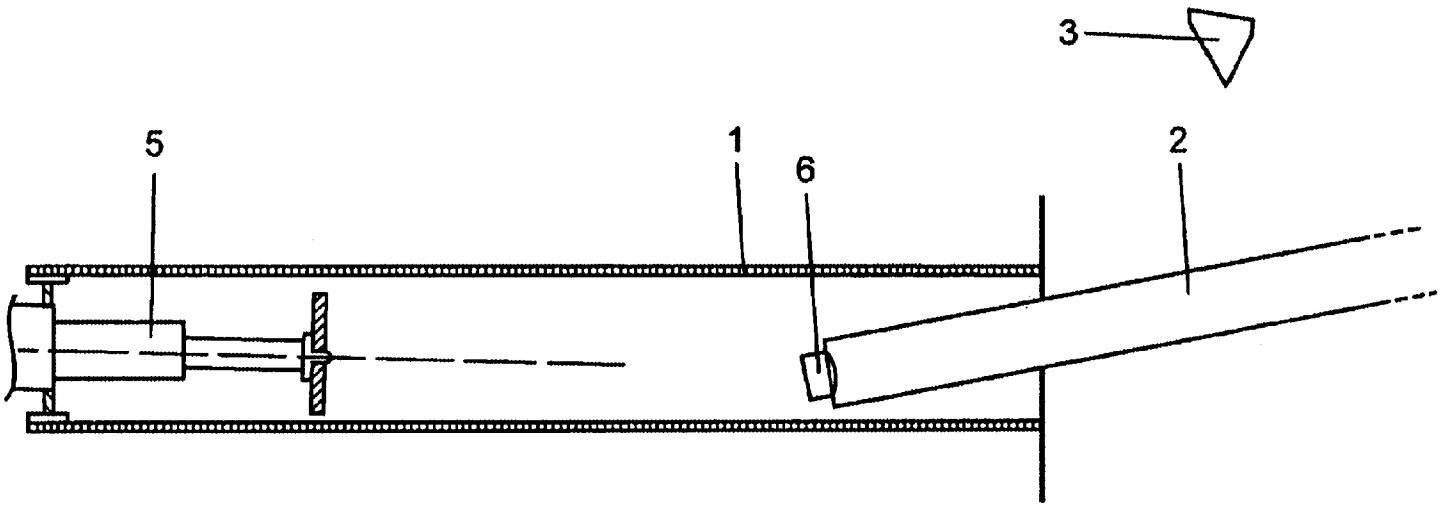
Figure 3D:
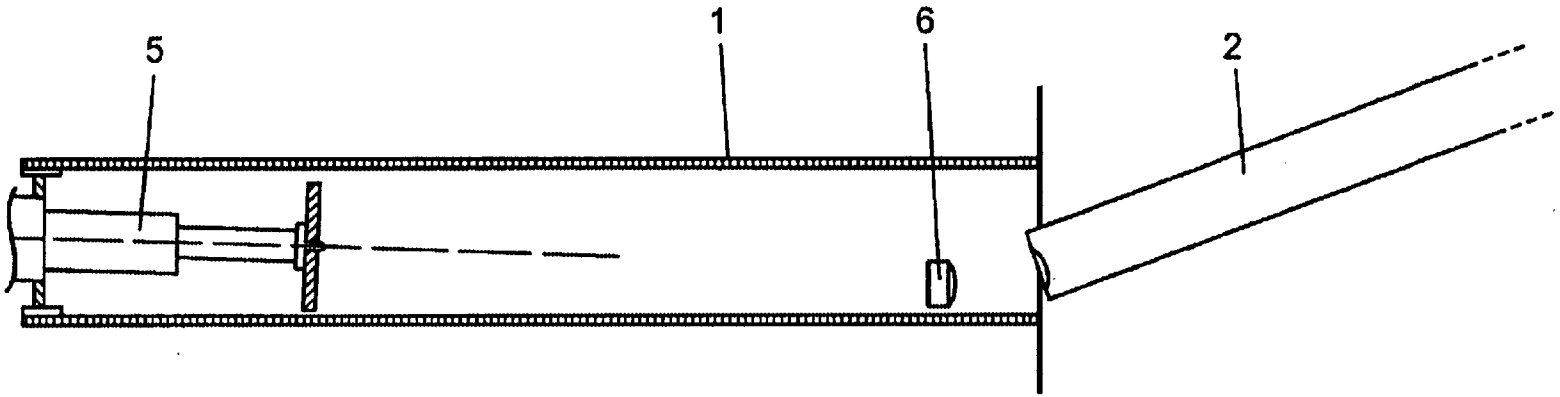

The annular gap which results from the loose fit of missile in bore may be filled at the front and/or rear of the missile body by lightweight spacer segments 3 which may be discharged with the missile and become detached from it as it leaves the housing. While the missile is dormant these spacers, or packings, locate the missile within the housing and protect it against chafing or fretting with the housing bore. The mouth of the housing (and egress point for the missile) would normally be sealed by either a frangible closure 12 (as shown in FIG. 3*b*) or a re-closeable door (as shown in FIG. 2).

At the base of the housing is a piston 4, or ram, and cylinder 5 arrangement which ejects the missile from the mouth of the tube when said cylinder is energised by high pressure fluid. As shown in FIG. 3*b* it is preferred to use a multi-stage telescopic piston powered by high pressure gas generated from a pyrotechnic source such as pyrotechnic gas generator 13. The choice of fluid and ram arrangement are dictated by installation and performance constraints.

The operation of the pyrotechnic gas generator and piston are not considered significant to the essence of this invention, and such devices are commonly found in missile ejectors for military aircraft (e.g. see UK patent 2078912). Indeed, for certain applications, it may be advantageous to employ compressed cold gas although this choice may dictate a larger and heavier system.

Figure 4A:
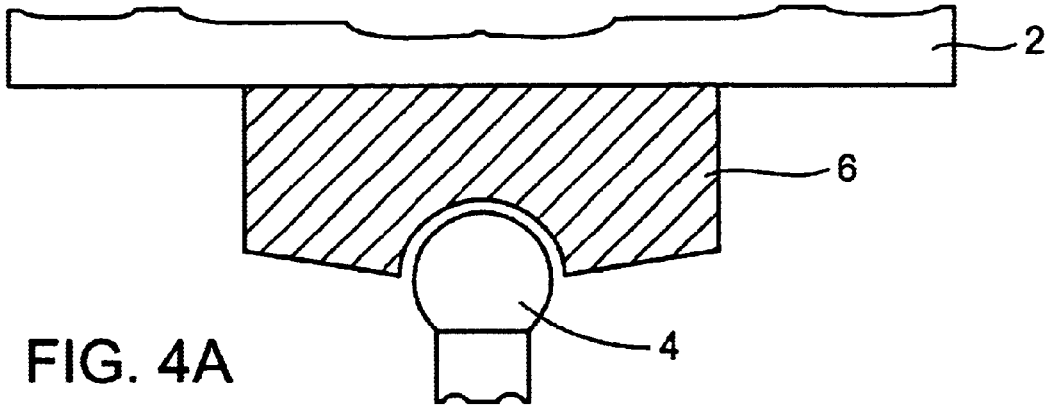
FIGS. 4*a* to 4*c* show cross-sections of a ball and spherical socket joint, a ball and conical socket joint, and a ball and cylindrical socket joint.
Figure 4B:
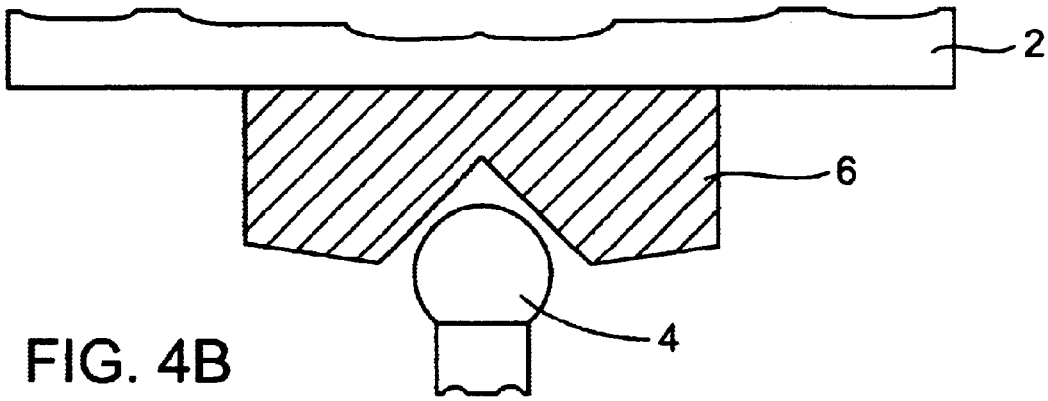
Figure 4C:
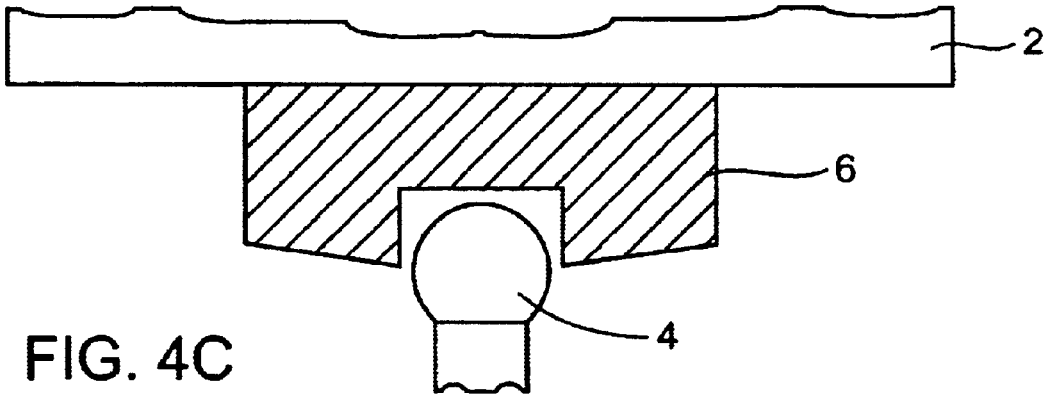

The ejector ram is pivotably engaged in a plug 6 which transmits the thrust of said ram to the base of the missile and also ensures that the ram remains accurately located on the central axis of the missile. FIGS. 4*a* to 4*c* show cross-sections of alternate embodiments of the plug 6 which include a ball and spherical socket joint, a ball and conical socket joint, and a ball and cylindrical socket joint.

The base of the ram cylinder assembly is also pivotably located, but to a thrust plate 7, which reacts against the force applied during missile ejection. This plate is connected to an orthogonal pair of linear actuators 8 & 9, arranged to provide a small but precise displacement of the cylinder axis in the plane of the thrust plate. The axis of the piston may then be adjusted to any point in a square defined by the travel of the actuators. In reality, the inscribed circle to that square will define the limits of travel required, enabling the azimuth angle and offset of the thrust vector to be finely adjusted. The important measure is the distance by which the thrust vector misses the centre of gravity of the missile. As this point is (in the example) 1 m from the end of the piston, a 3.5° angular offset gives a 60 mm linear offset, and in conjunction with the high thrust of the ram, generates a large turning moment in the direction of the offset.

The the thrust plate actuators are also of known type and may be any type of rapid response servo-mechanism. In order to prevent slippage of the thrust plate under piston reaction loads, a high friction bearing surface 10 is arranged to react the load, and this surface is retracted by leaf springs 11 to facilitate actuator driven alignment of the plate. Upon being loaded by piston thrust, the springs are compressed, and the friction surfaces are then brought into effect.

It can be shown that, for a 20 kg missile and a 40 kN thrust over 300 mm, a pitch angle well in excess of 35° can be obtained as the missile leaves the launch tube 67 milliseconds after first motion. By the time the rocket motor has reached full thrust, an angle of 90° is quite feasible. This is a fairly extreme case, but serves to demonstrate the capabilities of the system.

For a cylinder housing length of 300 mm, the 3.5° offset requires only 18.4 mm of motion at the thrust plate, and this can be achieved by electric or hydraulic actuators in the remainder of the 100 millisecond time window allowed for missile launch.

For airborne application of this invention it would be desirable to seal the open end of the launch housing after the missile has been launched. This could be done by hinged doors 12 which are initially held closed by shear wires or similar and which are forced open by the emerging missile and re-closed after launch by powerful springs. By this means, the smooth outer surface of the aircraft may be restored with attendant aerodynamic benefits. It is possible, by using a suitable linkage attached to the thrust plate, to employ the 'recoil' generated by the ejection piston to open the doors prior to missile egress and then employ a damper to prevent closure before the missile has completely emerged (see FIG. 2).

An important part of the system control is a reliable and rapid boost motor on the missile so that boost thrust is achieved as the missile becomes correctly oriented. Additionally (or alternatively) a series of lateral thrusters may be incorporated in the missile nose so that as correct missile attitude is sensed by internal 'gyros', an appropriately aligned thruster(s) is fired to cancel excessive rotation of the missile, and prevent it from pointing towards the host aircraft.

FIGS. 3*a* through 3*d* show a succession of images of a typical extreme launch situation, illustrating now a large angle may be obtained without a need for an impractical housing diameter.

It is most likely that the missiles appropriate for such rapid engagements will be finless or will have small foldable fins which can be stowed within the missile profile during its time within the housing. For this reason, no provisions have been made for fin clearance in this description. Such an assumption accords consistently well with current techniques for tube launching of guided missiles and will be even more applicable to the thrust vector controlled missiles of the future.

In operation, when a target or threat is detected by the sensor system which forms an essential part of any overall defense installation its azimuth and elevation are converted by a suitable algorithm into displacement requirements for the thrust plate actuators on the launcher. The relative movements of the actuators will rapidly place the moveable end of the cylinder at polar co-ordinates, where the vector angle represents the 'azimuth' setting, and the radius (i.e. displacement from the tube axis) represents the 'elevation' setting.

When the actuators have signalled their correct position the pyrotechnic gas generator is electrically initiated and energises the ejection ram.

First movement of the ram piston opens the skin-mounted egress doors, or breaks the frangible cover, as appropriate. Further movement releases any radial constraint on the nose of the missile, thereby allowing the moment induced by the offset rain force to start the desired pitch/yaw acceleration, velocity and displacement of the missile.

When the ram reaches the limit of its travel it is arrested by energy absorbing buffers within the cylinder. At this time, in the hypothetical example, the missile will be moving along the tube at a velocity of around 30 to 40 m/s, and a pitch/yaw rate of up to 10 radians per second. Approximately 30 milliseconds will have elapsed from initiation of the pyrotechnics.

As the missile approaches the muzzle end of the launch tube, the annular clearance allows greater angular displacement before contact could occur between missile and the inner wall of the housing. Because the centre of gravity of the missile moves in a line parallel to the thrust line of the ram, and the nose of the missile moves in an opposite radial sense, any contact between missile and tube would occur at the tail end of the missile.

The missile finally exits from the housing 80 milliseconds after initiation of the pyrotechnics, and is now at an angle of up to 35° from the axis of the housing, and moving in the direction of the threat.

The missile's rocket booster will now, for example, be initiated by a combination of a timed interval from an acceleration threshold having been achieved during ejection, and a gyro output confirming a safe angle of alignment.

Finally, if fitted, the launch housing's egress doors are closed and latched shut.

A system capable of pointing over 360° azimuth and 0 to 90° elevation will cover a full hemi-sphere. It therefore follows that two of these systems, mounted in opposite directions, will fully address a threat to the host aircraft from any direction.

The base of the piston could be positioned in a number of ways, for example by positioning the base of the piston by means of two or more positioning devices, preferably two low power, high speed actuators arranged at mutually perpendicular orientations which displace the base of the piston in a plane normal to the longitudinal axis of the tube. The contact between the piston and the base of the missile could be such that relative angular motion of piston and missile axes is possible, without significant relative motion in any translational direction perpendicular to the axis of the piston. This could be done, for example, by providing the contact between the piston and the base of the missile in the form of a ball and spherical socket joint, a ball and conical socket, or a ball and cylindrical socket joint.

The missile need not necessarily be directed by tilting of the piston as described above. Alternative means for offsetting the ejection axis from the longitudinal axis of the missile may readily be imagined. For example the piston may act along the axis of the housing with tilt means provided to control the angle between the longitudinal axis of the missile and the axis of the housing thereby controlling the amount and direction by which the ejection axis is off-set from the longitudinal axis of the missile. For example two low power, high speed actuators arranged at mutually perpendicular orientations situated along the length of the missile and acting to position the nose of the missile off the housing axis would suffice.

Alternatively the piston may act parallel to the housing axis and displaced from the longitudinal axis of the missile, the amount of displacement being selectively variable to control the amount and direction by which the ejection axis is off-set from the longitudinal axis of the missile.

Many alternative arrangements for providing the selected tumbling of a missile as it leaves its housing can be imagined and will fall within the scope of this invention.

What is claimed is:

1. A method of launching a missile in a given direction comprising the steps of:

i) storing a missile in a housing;

ii) ejecting the missile from the housing, prior to firing the missile, with a force acting along an ejection axis off-set from the longitudinal axis of the missile and imparting a tumbling motion to the missile, the direction of tumble being selected to decrease the angle between the longitudinal axis of the missile and the given direction; and iii) firing the missile and steering the missile to the given direction.

2. A missile launcher comprising:

i) a generally tubular housing in which a missile may be placed, the internal diameter of the housing being larger than the diameter of the missile; and ii) an ejector for ejecting the missile from the housing, prior to firing the missile, by a force acting along an ejection axis off-set from the longitudinal axis of the missile and imparting a tumbling motion to the missile to decrease the angle between the longitudinal axis of the missile and the given direction.

3. A missile launcher as claimed in claim 2 in which the ejector is a piston acting on the base of the missile.

4. A missile launcher according to claim 3, in which the piston is tilted relative to the longitudinal axis of the missile to control the amount and direction by which the ejection axis is off-set from the longitudinal axis of the missile.

5. A missile launcher according to claim 3, in which the piston acts along the axis of the housing and tilt means are provided to control the angle between the longitudinal axis of the missile and the axis of the housing to control the amount and direction by which the ejection axis is off-set from the longitudinal axis of the missile.

6. A missile launcher according to claim 3, in which the piston acts along the axis of the housing and tilt means are provided to control the angle between the longitudinal axis of the missile and the axis of the housing to control the amount and direction by which the ejection axis is offset from the longitudinal axis of the missile, such that the missile can be pointed over 360 degrees in azimuth and 0 to 90 degrees elevation.

7. A missile launcher according to claim 4 in which the piston is tilted by two or more positioning devices acting on the base of the piston.

8. A missile launcher according to claim 7 wherein the positioning devices are two low power, high speed actuators arranged at mutually perpendicular orientations which displace the base of the piston in a plane normal to the longitudinal axis of the housing.

9. A missile launcher according to claim 3 wherein the contact between the piston and the base of the missile is such that relative angular motion of piston and missile axes is possible, without relative motion in any translational direction perpendicular to the axis of the piston.

10. A missile launcher according to claim 9 wherein the contact between the piston and the base of the missile is a ball and spherical socket joint, a ball and conical socket joint, or a ball and cylindrical socket joint.

11. A missile launcher according to claim 3 wherein the piston is mounted to a thrust plate resiliently disposed relative to a fixed mounting piece such that axial recoil of the piston drives the thrust plate into frictional contact with the fixed mounting piece to prevent lateral displacement of the piston during contact of the piston with the missile.

12. A missile launcher according to claim 3 wherein the mouth of the housing is closed by doors, and axial recoil of the piston opens the doors to permit the missile to leave the housing on launch, the doors being self-closing after launch.

13. A missile launcher according to claim 3 wherein the mouth of the housing is closed by frangible doors.

14. A missile launcher as claimed in claim 2 capable of firing a missile at any azimuth angle of between 0 and 360 degrees, within 0.01 second of receiving a signal to launch.

* * * * *